US006016095A

United States Patent [19]

Herbert

[11] Patent Number: 6,016,095

[45] Date of Patent: Jan. 18, 2000

[54] SNUBBER FOR ELECTRIC CIRCUITS

[76] Inventor: Edward Herbert, 122 N. Shore Rd., P.O. Box 241, Greensboro, Vt. 05841-0241

[21] Appl. No.: 09/110,902

[22] Filed: Jul. 6, 1998

Related U.S. Application Data

[60] Provisional application No. 60/052,371, Jul. 11, 1997.

[51] Int. Cl.[7] ..... H01F 17/06; H01F 30/12

[52] U.S. Cl. ..... 336/175; 323/361

[58] Field of Search ..... 336/175, 173, 336/174, 176; 361/113, 58, 118; 323/361

[56] References Cited

U.S. PATENT DOCUMENTS

| | | | |
|---|---|---|---|
| 1,814,225 | 7/1931 | Neiss | 336/175 |
| 3,924,223 | 12/1975 | Whyte et al. | 336/175 |
| 4,665,357 | 5/1987 | Herbert | 336/175 |
| 4,845,606 | 7/1989 | Herbert | 336/175 |

FOREIGN PATENT DOCUMENTS

| | | | |
|---|---|---|---|
| 142-106 | 2/1979 | Germany | 336/12 |
| 141958 | 5/1980 | Germany | 336/12 |
| 1-26612 | 8/1989 | Japan | 336/173 |

*Primary Examiner*—Michael L. Gellner
*Assistant Examiner*—Anh Mai

[57] ABSTRACT

A snubber for electric circuits comprises a plurality of small lossy magnetic cores with a wire through each, wired in parallel. Such an arrangement will have a much faster saturation time than a single core of comparable volume, and the power dissipated will be distributed and have more surface area. With conventional lossy snubbers, the only choices are the size of the core and the material. With this snubber, the number of cores to use, and the size of the individual cores are additional variables available to the designer to optimize the snubber. A variation of the snubber uses a plate of lossy magnetic material with a plurality of through holes. This is comparable to using individual cores, but the one piece may be easier to handle and assemble.

3 Claims, 4 Drawing Sheets

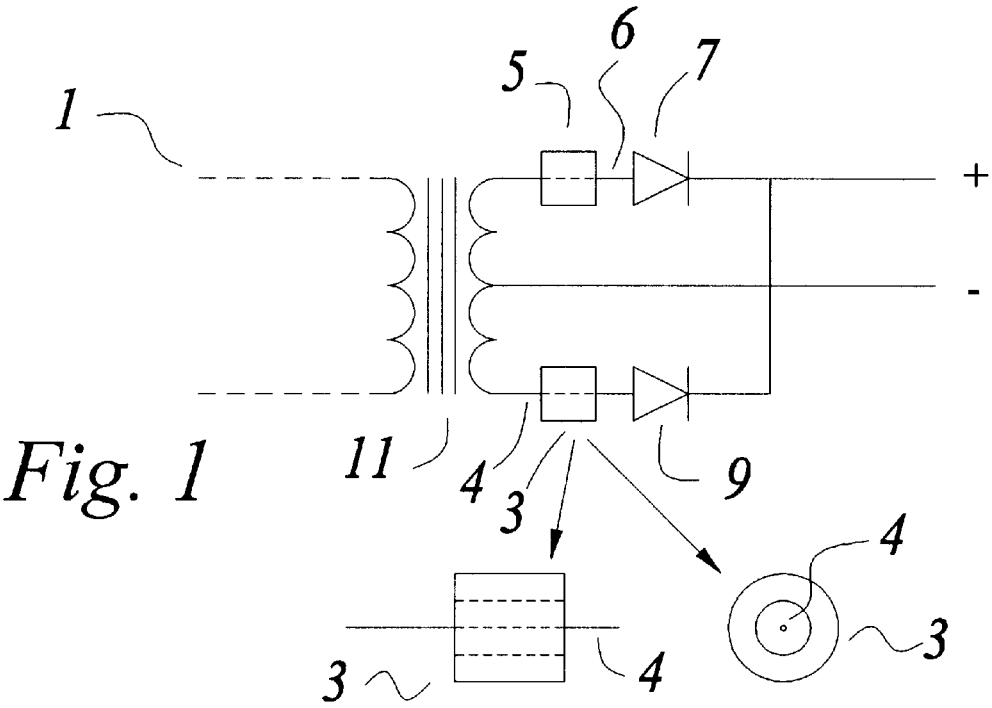
Fig. 1
Fig. 1a
Fig. 1b
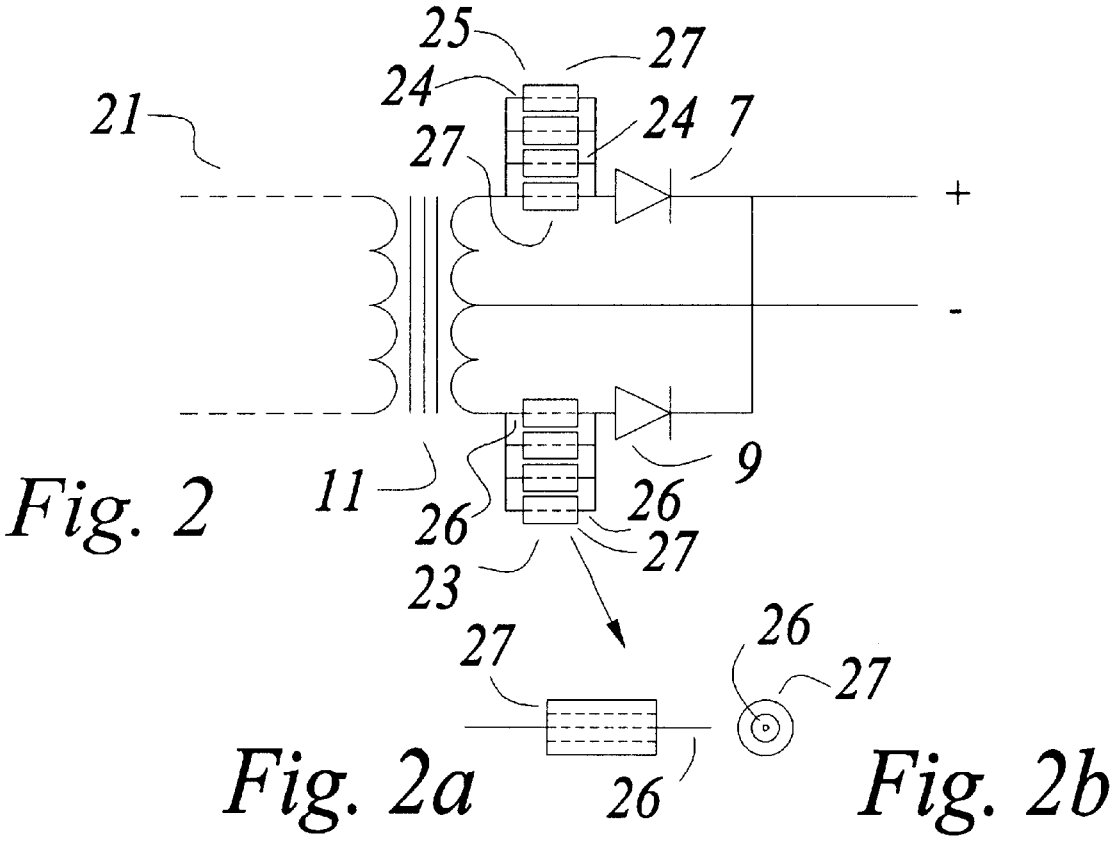
Fig. 2
Fig. 2a
Fig. 2b

SNUBBER FOR ELECTRIC CIRCUITS

This application for letters patent is a continuation in part application of a provisional patent application of the same name, Serial No. 60/052,371, filed Jul. 11, 1997.

BACKGROUND OF THE INVENTION

In designing and building electrical circuits, it is often necessary to include snubber circuits to damp spurious transients or oscillations. Often these employ resistors and capacitors in the familiar R-C snubber circuit, usually with the R-C in series across a switching means or rectifier, but sometimes other arrangements are used.

Snubber circuits assembled of components with leads are less effective at high frequencies because the "lead inductance" becomes a significant impedance at high frequencies. Therefore it has become common to employ lossy inductive components as snubbers. These are often in the form of a bead of magnetic material such as a ferrite bead or powdered iron bead or the like which can be slipped over one of the conductors of the circuit.

For many applications, it is impossible to find a suitable lossy inductive bead which will effectively damp an oscillation without introducing excessive losses or time delays or consuming too much energy.

OBJECT OF THE INVENTION

It is an object of the present invention to provide an improved snubbing means for electric circuits. By using a plurality of small lossy inductive beads (or their equivalent) in a parallel arrangement, a snubber can be made which will have optimal impedance characteristics, and which can absorb significant energy, yet which will saturate rapidly so as not to compromise circuit performance.

BRIEF DESCRIPTION OF THE DRAWINGS

Prior Art: FIG. 1 shows two beads which may be a ferrite bead or a powdered iron bead or the like installed over the leads of two rectifiers in a push-pull circuit on the output of a transformer. FIGS. 1*a* and 1*b* show side and end views of the bead.

FIG. 2 shows two sets four small beads in parallel installed in series with the leads of two rectifiers in a push pull circuit. FIGS. 2*a* and 2*b* show side and end views of one of the beads.

DESCRIPTION OF THE PREFERRED EMBODIMENT OF THE INVENTION

Figure 3:
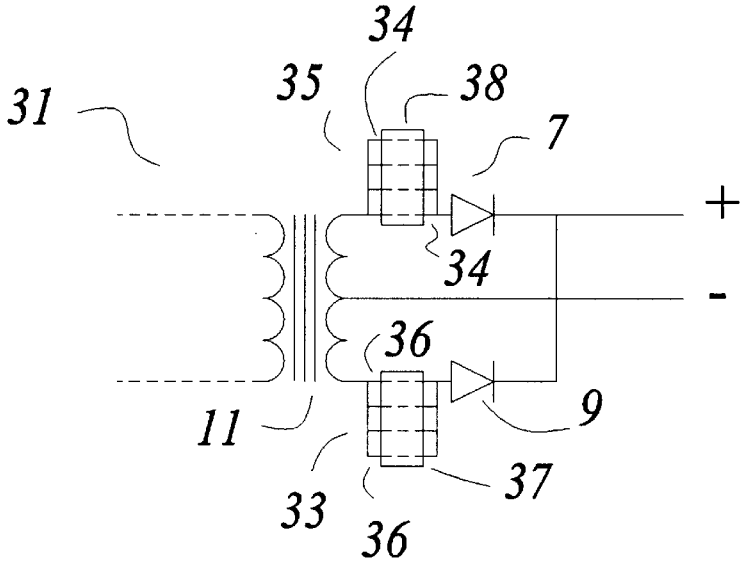
FIG. 3 shows two multi-aperture plates of lossy magnetic material used as snubbers for rectifiers in a push pull circuit.

Prior art: FIG. 1 shows a transformer circuit 1 having a transformer 11 with output rectifiers 7 and 9 as might be used in a switched mode power supply, excited, as an example, not a limitation, by a pulse width modulated square wave.

Most rectifiers, and Schottky rectifiers in particular, have a fairly high junction capacitance, and transformer windings and their external circuits inherently are inductive. Of particular concern in the present example is the leakage inductance of the secondary winding.

When the voltage across a reversed biased rectifier changes rapidly, its parasitic junction capacitor must charge or discharge, changing the stored energy therein. As the charge on the parasitic junction capacitor changes, large currents of short duration must flow, and these change the stored energy in the parasitic and other inductances of the transformer winding. This can result in an oscillatory ringing in the voltage and current wave forms in the circuit, all too familiar to anyone who has worked with rectifying circuits in switched mode and similar circuits. R-C snubbers are frequently used in an attempt to damp these oscillations. Often, much more than the theoretical snubbing is needed to overcome the lead inductance of the R-C components, resulting in excessive losses and heat dissipation. Even so, the snubbing may not be very effective, resulting in excessive voltage on the rectifier and the generation of undesirable noise or electro-magnetic interference (EMI).

Snubbing circuits to damp an L-C oscillation can, in theory, introduce a critical resistance component either in series, or in parallel with one of the components. In practice, a resistance is usually placed in parallel with the capacitance, which, in the present instance, is the parasitic capacitance of the rectifiers 7 or 9. To prevent DC and low frequency losses, a blocking capacitor is placed in series with the resistor, resulting in the familiar R-C snubber circuit. There are a number of problems with this arrangement, not the least of which is that, being a parallel circuit, it increases the current inrush when the voltage changes rapidly. It would be much preferred to use a series resistance, as that would reduce the inrush current. Unfortunately, a series resistor cannot be used in the main current paths of the circuit. It would dissipate far too much power.

Oscillations in the rectifiers can be reduced by reducing the rise time of the switching transitions in the driving circuits (not shown). Unfortunately, this increases the cross-over losses in the switches of the drive circuit, and also limits the maximum duty cycle in a pulse width modulated circuit. The present trend in power supplies is to higher and higher frequencies, necessitating operating with fast switching times.

In FIG. 1, showing prior art, a pair of beads 3 and 5 have been installed on the leads of the rectifiers 7 and 9 respectively by passing the conductors 4 and 6 to the rectifiers 7 and 9 through the center holes of the beads 3 and 5. This technique is well known, and often is quite helpful in controlling oscillations and EMI. Lossy magnetic beads exhibit a significant lossy component of their complex inductance at high frequencies. The imaginary component of the complex inductance is lossy and serves well as a restive element at the frequency of the spurious oscillations while having a low impedance at the operating frequency of the circuit. This is the theory, at least, and often is closely approximated in practice.

In a push pull circuit, a snubber is necessary on both legs of the circuit. While one leg is conducting, the rectifier of the other leg is reversed biased. It is on the reversed biased rectifier that oscillations occur due to resonance in the circuit parasitic inductances and capacitances, particularly the transformer leakage inductance and rectifiers junction capacitance. A lossy inductive component can be an effective damping component at the frequency of the spurious oscillations.

Forward current flows in the other leg of the push pull circuit. An unfortunate consequence of using a lossy inductive component is that the component will also resist the flow of current in that path as well, for a time, until the core saturates. This can delay the rise of current in the forward direction, and create a limit on the maximum duty cycle in a pulse width modulated circuit. The cures for this are to use a low permeability material, and to use a small core. Unfortunately, this limits its effectiveness as a snubber.

There are several factors which can reduce the effectiveness of the lossy magnetic beads or make them less suitable as a circuit element. There must be a fairly careful balance between the flux capacity of the bead, its inductance and the power that it dissipates as well as the characteristics of its B-H loop. A material that has too high an inductance will simply block current until it saturates, then conduct abruptly, causing a delay followed by an oscillation which is almost as bad as if no bead were used. A material that has too low an inductance will not introduce sufficient losses to damp the oscillation. A bead that is too large will have excessive losses and slow the rise times excessively.

Figure 4:
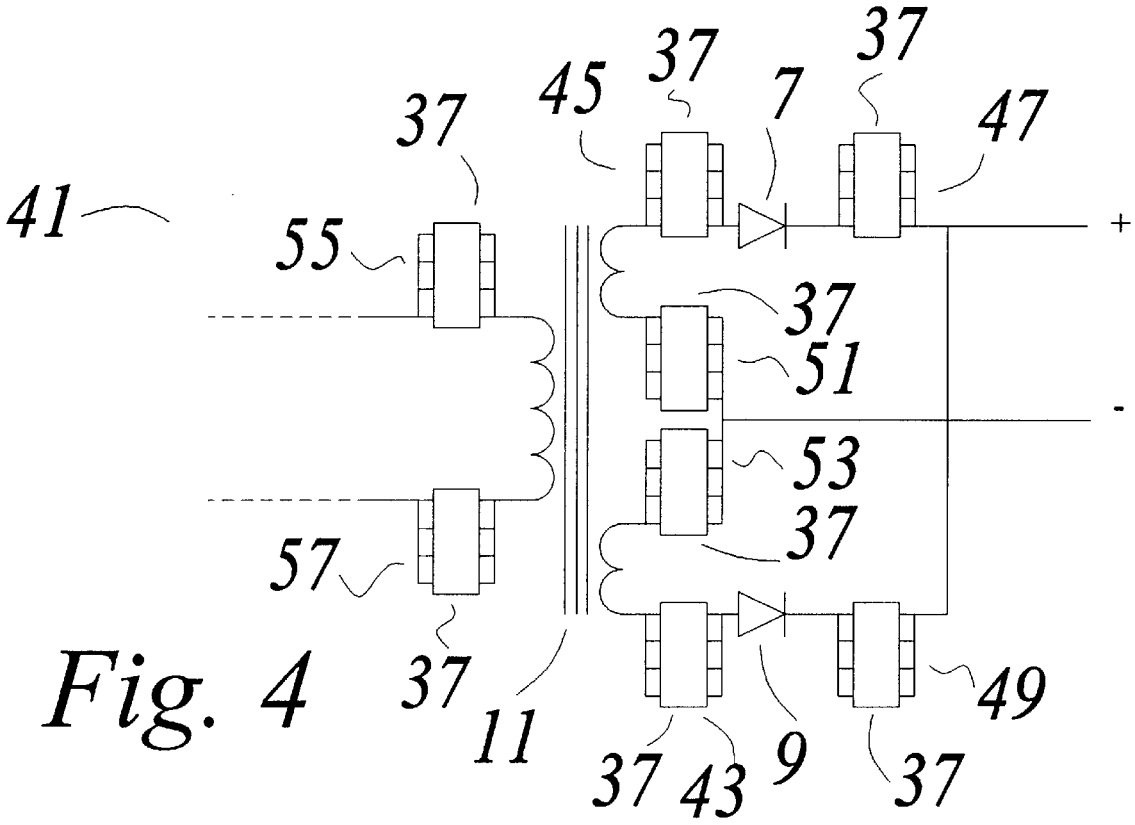
FIG. 4 shows various locations in a push pull circuit where the snubber of this invention may be used, as an illustration, not a limitation

In a typical rectifying circuit employing flat transformers modules of about 150 watt rating and using dual Schottky rectifiers with an operating frequency in the order of 300 kHz., the spurious oscillation on the reversed biased rectifier tends to be in the order of 40 MHz. This can be reduced significantly with an R-C snubber placed across the rectifiers, a common and well known technique. Even more effective was a small ceramic capacitor with lossy magnetic beads on its leads. Better results yet were obtained with the circuit of FIG. 1. The snubbing was comparably effective and had some other benefits when the beads were installed in the center-tap leads of the transformer before the common connection (as shown in FIG. 4, and discussed further below).

Unfortunately, beads that were large enough to completely damp the oscillation (critically or over damp it) introduced an unacceptable delay in the rise time and dissipated much too much power, indicating excessive losses. A very small bead helped, but could not absorb and dissipate sufficient energy, so the oscillations still had an unacceptable amplitude and duration.

FIG. 1*a* shows a side view of the bead 3 with the conductor 4 passing through its center. FIG. 1*b* shows an end view of the bead 3 and the conductor 4.

FIG. 2 shows two snubbers 23 and 25 of this invention in series respectively with the rectifiers 7 and 9, each of the snubbers 23 and 25 comprising four smaller beads 27-27 wired in parallel by passing conductors 24-24 and 26-26 through the holes in the beads 27-27. The conductors 24-24 are connected in parallel by connecting together all of the conductors 24-24 on both sides of the beads 27-27 as shown in the schematic diagram FIG. 2. The conductors 26-26 are connected in parallel by connecting together all of the conductors 26-26 on both sides of the beads 27-27 as shown in the schematic diagram FIG. 2. This arrangement is highly effective at damping the rise time of the voltage on the reverse biased Schottky rectifier while having a much shorter saturation time and lower overall dissipation. The flux capacity of each core is very small, and each core of a set is exposed to the same voltage for the same time. The current through the snubbers 23 and 25 divides, and each individual core 27-27 sees a proportionate share of the current.

The saturation of the snubbers 23 and 25, being determined by the flux capacity of the cores and the volt-seconds seen by the cores, has the characteristics of a very small core. The inductance of each core 27-27, and in particular, the imaginary component of the complex inductance, is determined by the complex permeability of the material, the effective area and the mean magnetic length, and, of course, its degree of saturation. The inductance of the snubber 23 or 25 is reduced in proportion to the number of cores 27-27 used in parallel.

With multiple cores, the power to be dissipated is divided among them. Each core can have a relatively high inductance while the snubber as whole has a lower inductance.

The ability of the lossy magnetic material to absorb energy is often described in terms of its "resistance" at various frequencies. Often a table or graph is used to show its variation with frequency. In theory, one can try to identify the resonant components which are causing the ringing, then calculate the needed damping resistor, and insert the appropriate bead. In practice, this is less successful, usually resulting in a trial and error selection until a useable compromise is found.

The actual magnetic performance is more complicated. The inductance, and therefore the lossy imaginary component of the complex inductance is quite non-linear, and varies with time as the flux density of the core approaches saturation. Different core materials have different hysteresis loop characteristics, some being more "square" than others.

In a "square loop" material, as current begins to flow through the core, there is little impedance until the current reaches the level of the "switching current", which is determined by the coercive force of the material and its mean magnetic path length. Once the switching current is reached, the flux density of the core increases, resulting in a counter electromotive force (emf, or voltage), which bucks any further increase in the current. After a time, the core "saturates" (the flux density reaches its maximum value), and no further counter emf is possible. The time that it takes to saturate the core depends upon the state of the flux initially, the saturation flux density of the material, the effective cross section of the core, and the volt-seconds seen by the core. These relationships are well understood by one skilled in the art of magnetic circuit design.

In an "ideal square loop" core, the current is limited at a constant value while the lux is switching, until the core saturates. In a practical core, this effect is reduced, but still operative to a degree. In a switching power converter, when the power flow reverses at the beginning of each half cycle of conduction, a voltage source (the transformer output emf.) is connected directly to a capacitance (the reverse-biased rectifier). If the switching time is very fast, the current flow into the capacitor is limited only by the circuit impedances, which are very small in a well designed power supply. Given that the circuit has some inductance, the capacitor tends to charge resonantly to two times the circuit voltage, then oscillate until the excess energy is dissipated. The resonant charging results from there being a very large peak current flowing through the inductance, storing energy that is then transferred to the capacitor as excess voltage, as is well known to one skilled in the art.

The lossy inductive snubber operates through two mechanisms. One is the current is limited by the "switching current" of the core, so it cannot rise to a very large peak value. Second, being lossy, much of the energy is absorbed rather than being stored, and is not returned to the circuit.

If the "switching current" of the core is too low, the current will be blocked at a low level until the core saturates, then will flow unimpeded. This results in a delay, then a resonance almost as bad as if no core were used. If the "switching current" is too high, large peak currents can flow, the capacitor will peak charge, and resonance will occur. For considerations of forward conduction, the core must saturate very quickly. This is difficult, and often impossible, to achieve in a single core.

Using a plurality of cores, the value of the "switching current" can be manipulated by varying the number of cores in parallel, it being simply additive. The individual cores can be very small, allowing fast times to saturation. The power dissipated is spread among the cores, and the surface to volume area is increased.

Using the example of a 40 MHz ringing frequency, the period of one half cycle is 12.5 ns. The voltage peak is at half that time, roughly 6 ns, at which time the current is zero. At half that time, or roughly 3 ns, the current peaks. By limiting the peak current, the charging time of the capacitor is longer, but it can still be fast. If the lossy component of the complex inductance is significant, there will be little or no overshoot Steady state can be achieved very quickly, in the order of 10 or 20 ns, after which the function of the snubber is done, so the core can have a saturation time of that order of magnitude.

FIG. 2*a* shows a side view of the bead 27 with the conductor 26 passing through its center. FIG. 2*b* shows an end view of the bead 27 and the conductor 26.

FIG. 3 shows snubbers 33 and 35 in series with rectifiers 7 and 9. Each of the snubbers 33 and 35 comprising, respectively, flat plates 37 and 38 with multiple holes therein of lossy magnetic material. Conductors 34-34 and 36-36, respectively, pass through holes in the plates 37 and 38. The flat plates 37 and 38 can be substituted for a number of separate cores. While the performance is comparable, the one piece is easier to handle for manufacture.

Figure 3A:
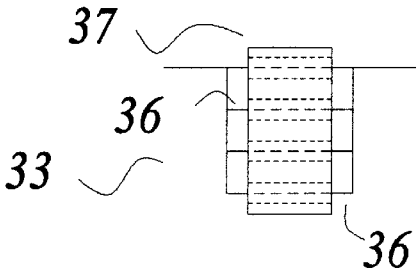
FIGS. 3*a* and 3*b* show side and end views of on of the multi-aperture magnetic plates.
Figure 3B:
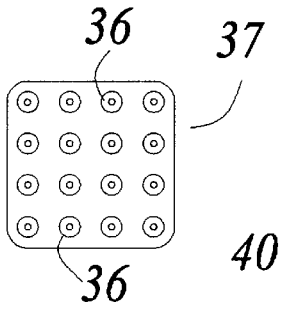
Figure 3C:
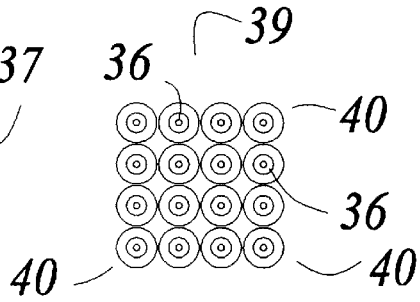
FIG. 3*c* shows an equivalent array of individual small beads.

FIG. 3*a* shows a side view of the flat plate 37 with the conductors 36-36 passing through the holes therein. FIG. 5*b* shows a plane view of the flat plate 37 and the sixteen conductors 36-36 passing through the 16 holes therein. FIG. 3*c* shows an equivalent array 39 of sixteen individual cores 40-40. Each of the sixteen holes in the plates 37 and 38, or each of the holes through the sixteen cores 40-40 of the array 39 would have a wire through it, and all of the wires would be wired in parallel to make the snubber by connecting together the conductors 34-34 and 36-36 respectively on both sides of the snubbers 33 and 35, as shown in the schematic diagrams of FIGS. 3 and 3*a* (or their equivalent if an array 39 of individual cores 40-40 is used).

FIG. 4 shows that the snubber of this invention can be used effectively in a number of locations in the circuit 41 relative to the transformer 11 and the rectifiers 7 and 9, either as alternative locations or in various combinations, as examples, not limitations. As an example, not a limitation, each of the snubbers 43, 45, 47, 49, 51, 53, 55 and 57 comprises the flat plate 37 of FIG. 3, wired as discussed above.

Because the circuits comprising the secondary windings of the transformer 11 and the rectifiers 7 and 9 are series circuits, placement of the snubbers in the series circuits is arbitrary, in theory. If one snubber is used in each side, snubbers 45, 47 and 51 are nearly equivalent, as are snubbers 43, 49 and 51. At the frequencies of interest, however, the circuit is not purely a series circuit, there being numerous parasitic conduction paths through parasitic and stray capacitances. If dual common cathode rectifiers are used, the locations of snubbers 47 and 49 are not accessible.

Judicious placement of the snubber can make it have a dual role. Placing snubbers 43, 45, 51 and 53 on both sides of each of the transformer secondary windings (relative to the transformer 11, using four snubbers) quite effectively reduced noise coupled from the primary through the inter-winding stray capacitance while completely suppressing rectifier oscillations. One or two snubbers 55 and/or 57 can reduce noise in the primary and modify the rise time of the primary wave form without excessive crossover losses.

FIGS. 5*a*, 5*b*, 5*c* and 5*d* show that a small metal plate 65 with a plurality of drawn protrusions 64-64 can form the parallel conductors through a thin lossy magnetic plate 63 having multiple holes. A top metal plate 67 soldered to the protrusions 64-64 makes the parallel common connections to the other side.

Figure 5A:
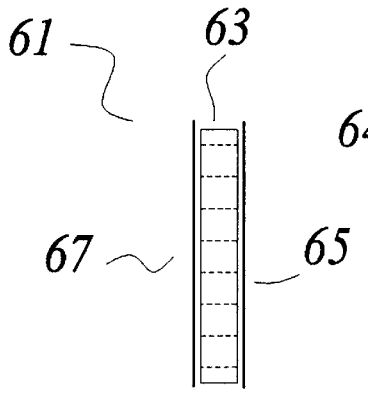
FIGS. 5*a*, 5*b*, 5*c* and 5*d* show side, plane and sectional views of a snubber of this invention having a multi-aperture plate, a flat plate and a plate having a plurality of drawn protrusions.
Figure 5B:
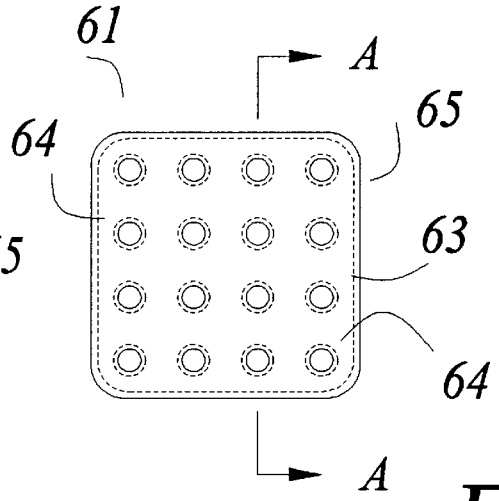

FIG. 5*a* shows a side view of a snubber 61 comprising a small metal plate 65, a thin lossy magnetic plate 63 and a top metal plate 67. The holes in the plate 63 and the protrusions 64-64 are represented in phantom by dashed lines.

FIG. 5*b* shows a bottom view of the snubber 62. The small metal plate 65 can be seen with the protrusions 64-64 shown from their reverse side. The periphery of the thin lossy magnetic plate 63 and the holes therein are shown in phantom by dashed lines.

Figure 5C:
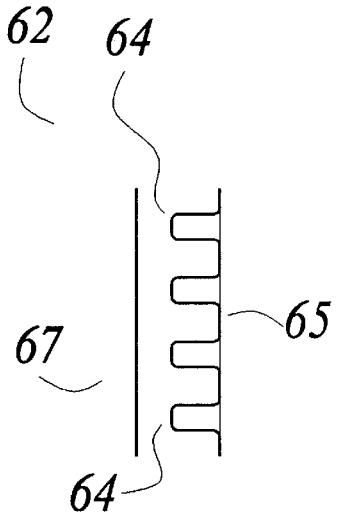

FIG. 5*c* shows the conductor system 62 comprising the small metal plate 65 with protrusions 64-64 therein and the top metal plate 67 in position to be placed on the snubber 61 once the thin lossy magnetic plate 63 is installed.

Figure 5D:
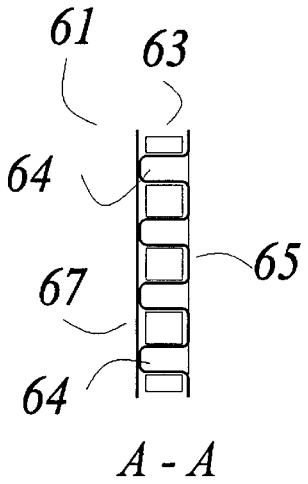

FIG. 5*d* shows a section view A—A of the completed snubber 61. It can be seen that the top metal plate 67 is soldered to and connects with all of the protrusions 64-64 of the small metal plate 65 to form a parallel connection thereof As the small metal plate 65 is inherently a parallel connection, it being formed from one piece of metal, a parallel connection is thus formed of the conductors (the protrusions 64-4) on both sides of the thin lossy magnetic plate 63, so as to be the functional equivalent of the snubbers 33 and 35 of FIGS. 3 through 3*b*.

Other structures could perform equivalently. A series of wire like protrusions could be formed by casting or as an impact extrusion, allowing the use of smaller holes and more of them. Connection would be similar. Two plates each with a plurality of holes could be wired through the thin lossy magnetic plate 63 in the manner of cordwood construction. Given that some magnetic materials can withstand very high temperatures, possibly the top and bottom plates and the connections between them could be cast as a single process.

Figure 6:
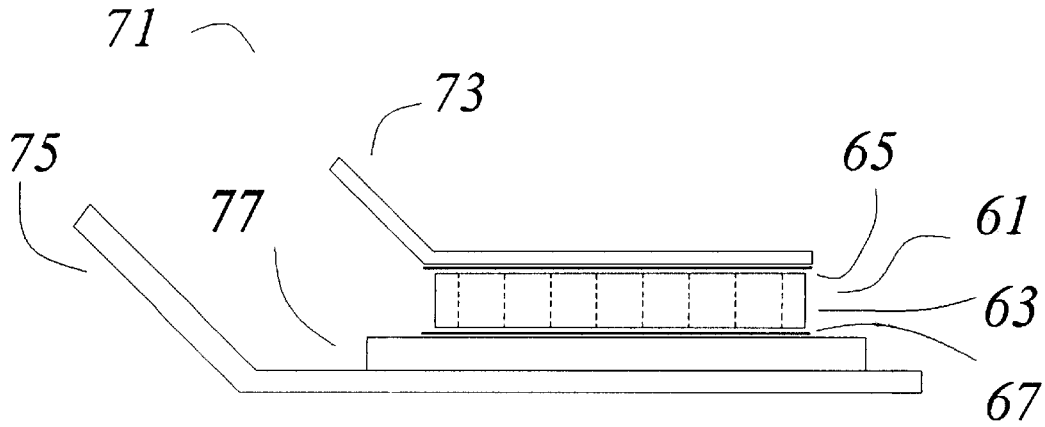
FIG. 6 shows a snubber of this invention installed in a rectifier package.

FIG. 6 shows that the snubber 61 of FIGS. 5*a*, 5*b* and 5*c* can be assembled into a rectifier package 71. A rectifier die 77 is mounted on a bottom conductor 75, shown as an example, not a limitation as a metal plate with a terminal tab. The snubber 63 comprising a multi-aperture lossy magnetic plate 63 and a top conductor 65 which may have multiple drawn protrusions for making contact with a bottom conductor 67 through the openings in the multiple aperture lossy magnetic plate 63. A top conductor 73 provides a second termination for the rectifier package with integral snubber.

In high frequency circuits, it is important to keep lead lengths and interconnections as short and wide as possible, to reduce leakage inductance. Further, it is preferred to have counter-flowing currents to partly cancel the far field, to further reduce leakage inductance and radiated emissions.

One way to do this is to integrate the snubber with the rectifier as shown in FIG. 6. Another way would be to incorporate the snubbers within the transformer or on its surface, as part of its terminations.

Powdered iron is used as a generic term for sintered metal cores of various compositions. Ferrite is used as a generic term for any ceramic magnetic material. For other applications or frequencies laminated steel or amorphous metal may be useful as the magnetic core material. All are generically identified as "magnetic material" in this specification and the claims. Other arrangements which provide the equivalent of a plurality of small magnetic cores wired in parallel would function similarly, as an examples, not a limitations a circular or linear array.

One skilled in the art of electric circuits would recognize that the circuits shown are incomplete, and are just one of many examples of circuits which might require snubbers. They show the points of novelty of this invention and the preferred method of making and using the invention. One skilled in the art would understand from these examples how to apply the teachings of this invention to other applications and other circuits requiring snubbers.

I claim:

1. A snubber for electric circuits comprising:

a plurality of cores made of a lossy magnetic material the cores having a low flux capacity so as to saturate quickly and the lossy magnetic material having a significant imaginary component of complex inductance each of the plurality of cores having a through hole therein, and a plurality of electrical conductors, each of the plurality of electrical conductors further having a first end and a second end, the plurality of electrical conductors passing respectively through the through holes of the plurality of cores, such that the through hole of each and every one of the plurality of cores has one and only one of the plurality of conductors passing through it, and the plurality of electrical conductors further being connected in parallel at both ends of the plurality of electrical conductors by connecting all of the first ends of the plurality of conductors together and by connecting all of the second ends of the plurality of conductors together so as to make a parallel-connected array of the plurality of cores, and the plurality of electrical conductors.

2. A snubber for electric circuits comprising a plate made of a lossy magnetic material, the lossy magnetic material having a significant imaginary component of complex inductance the plate of a lossy magnetic material having a plurality of through holes therein so that the plate is the equivalent of an array of cores having a low flux capacity so as to saturate quickly, and a plurality of electrical conductors, and each of the plurality of electrical conductors further having a first end and a second end the plurality of electrical conductors passing respectively through the through holes such that each and every one of the through holes has one and only one of the plurality of conductors passing through it, and the plurality of electrical conductors further being connected in parallel at both ends of the plurality of electrical conductors by connecting all of the first ends of the plurality of conductors together, and by connecting all of the second ends of the plurality of conductors together so as to make a parallel-connected array of the plurality through holes in the plate of a lossy magnetic material and the plurality of electrical conductors.

3. A snubber for electric circuits comprising a plate made of a lossy magnetic material, the lossy magnetic material being characterized by having a significant imaginary component of complex inductance the plate of a lossy magnetic material having a plurality of through holes therein so that the plate of lossy magnetic material is the magnetic equivalent of an array of cores having a low flux capacity so as to saturate quickly, and a plurality of electrical conductors, there being one of the plurality of electrical conductors for each one of the plurality of through holes, the plurality of electrical conductors comprising a plurality of protrusions from a first plate of electrically conductive material, and the first plate of electrically conductive material thereby comprising a first parallel connection for the plurality of electrical conductors the plurality of protrusions being in registry with and extending through the through holes in the plate of lossy magnetic material, and a second plate of electrically conductive material connected to the plurality of protrusions which extend through the through holes in the plate of lossy magnetic material so as to comprise a second parallel connection for the plurality of electrical conductors so as to make a parallel-connected array of the plurality through holes in the plate of a lossy magnetic material and the plurality of electrical conductors.

* * * * *